US005522465A

United States Patent [19]

Deare

[11] Patent Number: 5,522,465

[45] Date of Patent: Jun. 4, 1996

[54] METHOD AND APPARATUS FOR A SAFETY SYSTEM

[76] Inventor: Frederick L. Deare, 816 Church St., Jeanerette, La. 70544

[21] Appl. No.: 268,975

[22] Filed: Jun. 30, 1994

[51] Int. Cl.[6] ..... E21B 34/04; E21B 34/16; F17D 3/01

[52] U.S. Cl. ..... 166/363; 166/53; 166/64; 166/250.15; 137/624.18

[58] Field of Search ..... 166/250, 363, 166/364, 53, 64, 250.15; 405/195.1; 137/14, 487.5, 624.18

[56] References Cited

U.S. PATENT DOCUMENTS

| | | | |
|---|---|---|---|
| 3,454,083 | 7/1969 | Brooks | 166/363 |
| 5,191,937 | 3/1993 | Cook, Sr. | 166/363 |
| 5,385,207 | 1/1995 | Cook, Sr. | 166/53 |

*Primary Examiner*—Stephen J. Novosad
*Attorney, Agent, or Firm*—C. Dean Domingue

[57] ABSTRACT

A method and apparatus for controlling a production facility containing a well that produces subterranean fluids and gas is disclosed. The production facility is connected to a receiving facility by a pipeline having a pipeline pressure. The production facility has a remote control system that has operably associated therewith a controlling valve member, and a safety system containing a surface valve, and a subsurface valve. Generally, the method comprises the steps of setting the following pressures: a pipeline high pressure level, a pipeline low pressure level, a control system upper pressure level, and a control system lower pressure level. Next, the receiving facility is shut-in, and the pipeline pressure is monitored. According to the pressure level achieved in the pipeline, a signal in response thereto is generated, and thereafter a remote control system valve member may be activated thereby closing the valve. Next, the length of the closure may be timed and the pipeline is continuously checked for leaks before the valve member is reopened.

17 Claims, 15 Drawing Sheets

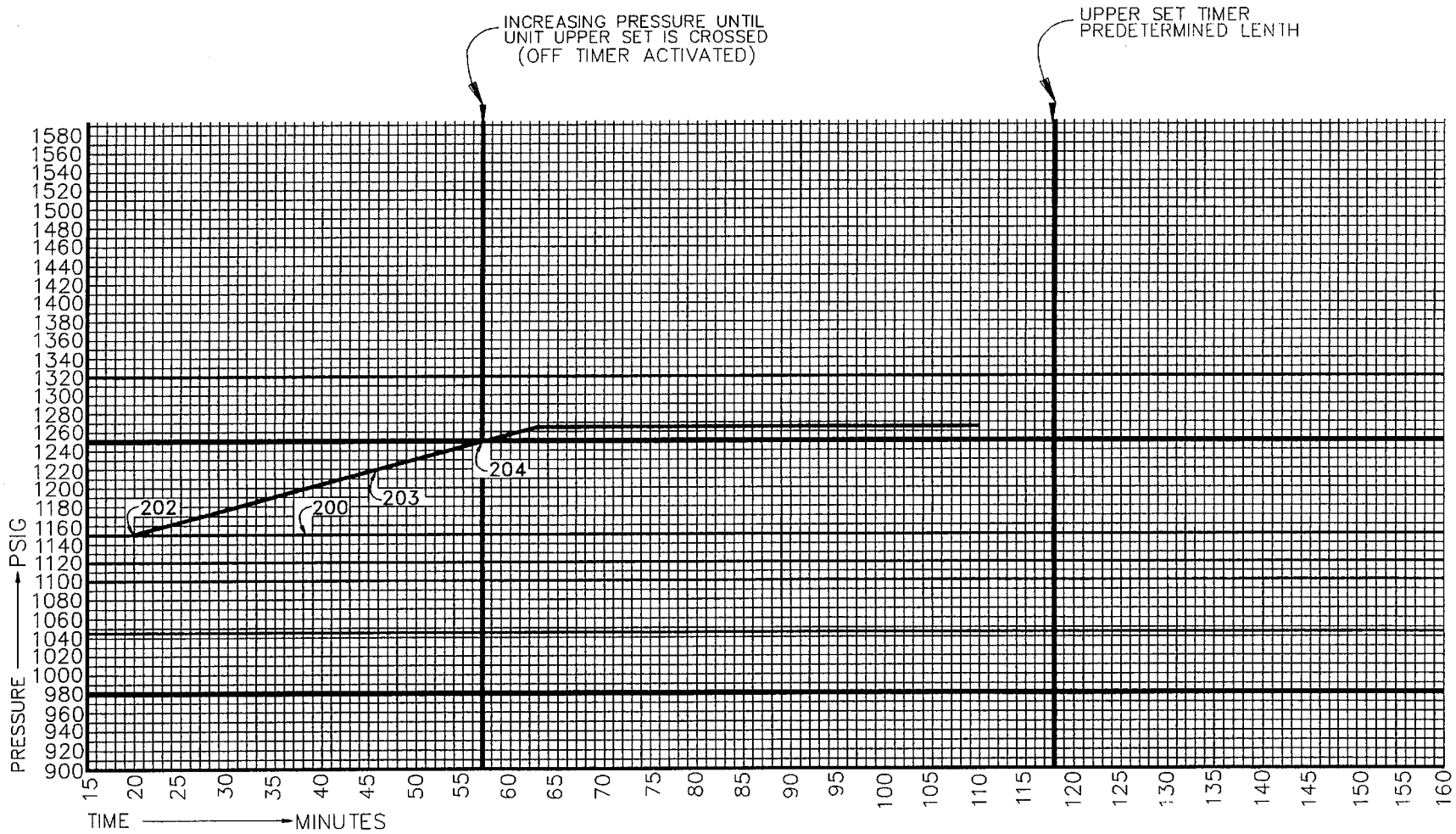
FIGURE 4-A

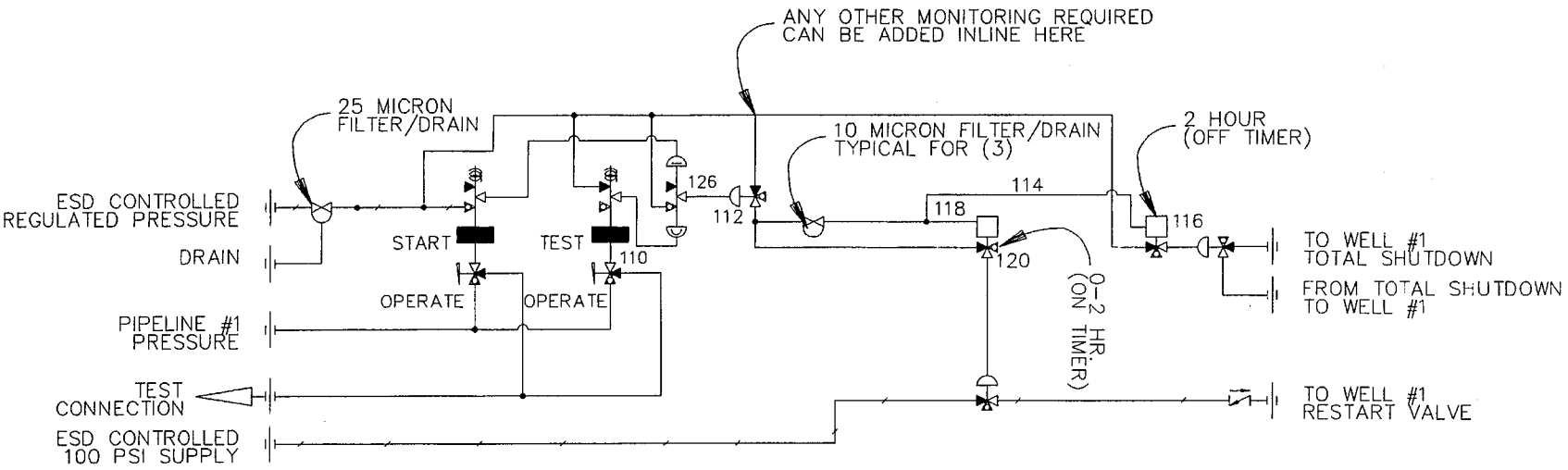
FIGURE 4-B

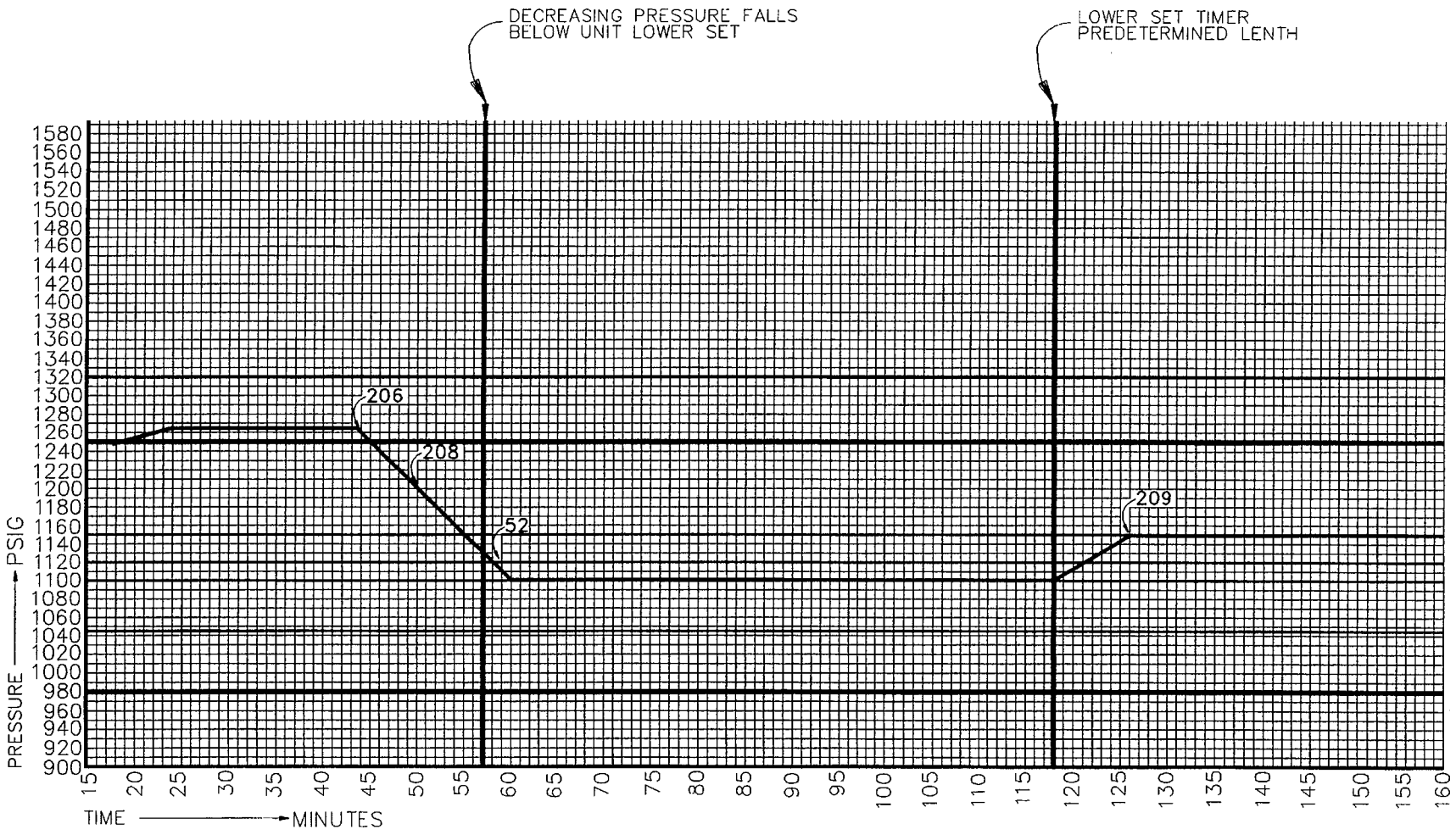
FIGURE 5—A

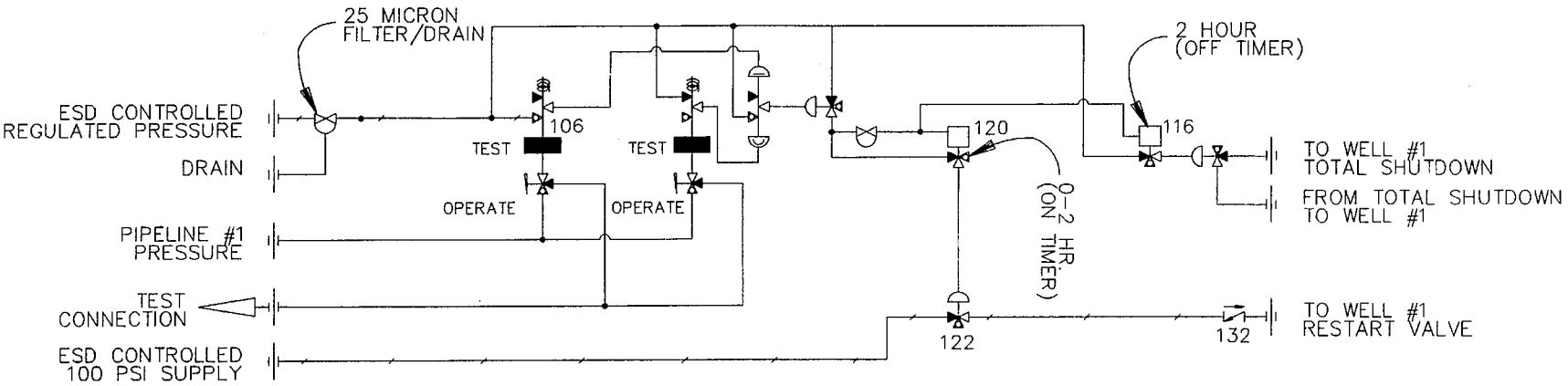
FIGURE 5-B

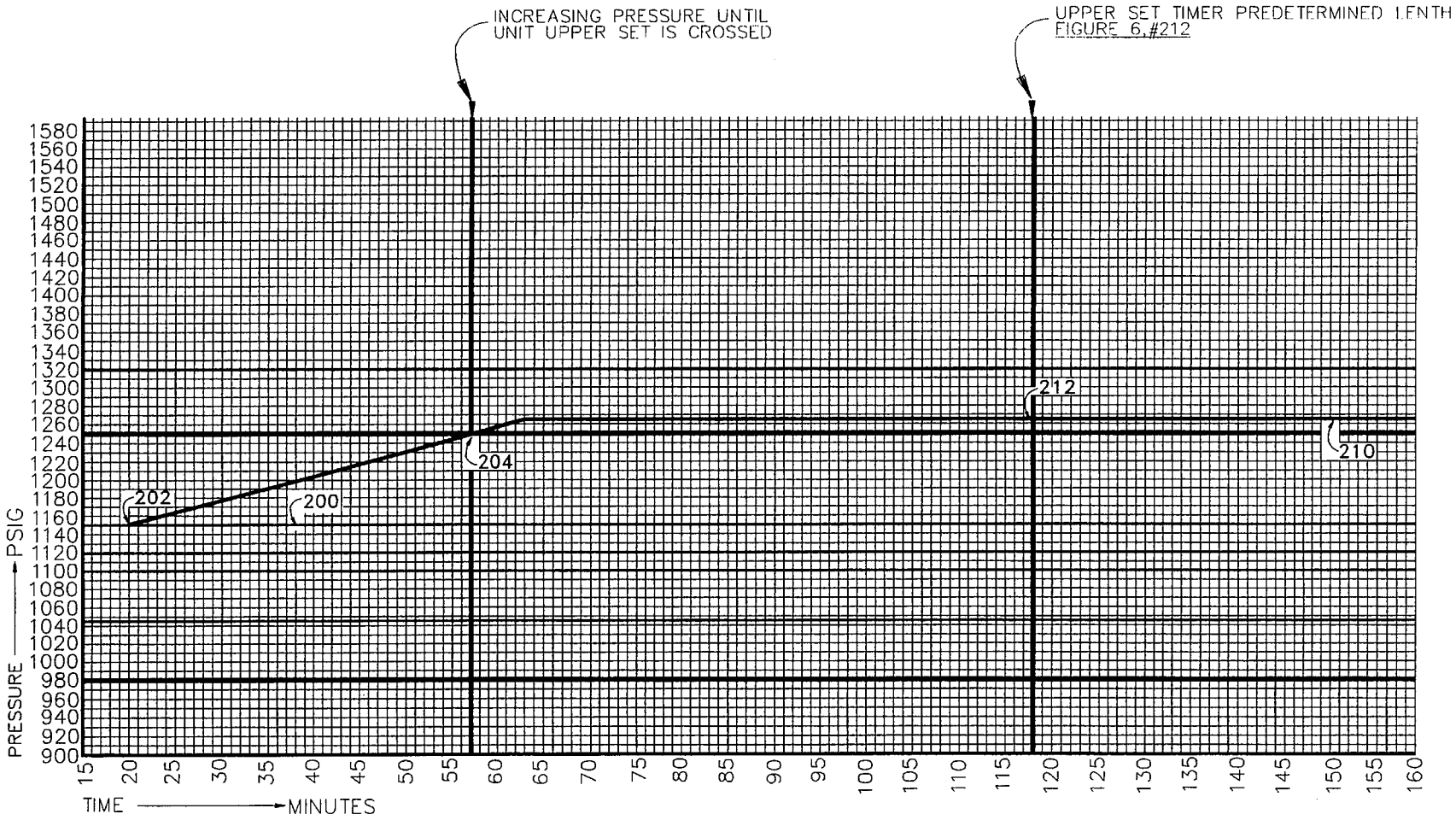
FIGURE 6—A

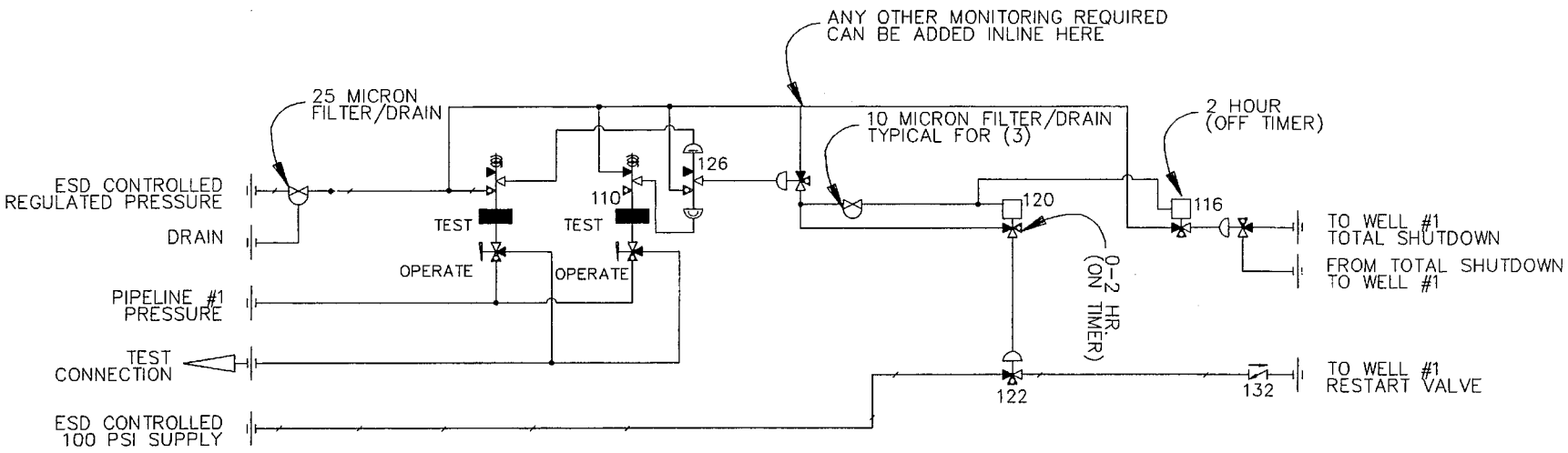
FIGURE 6-B

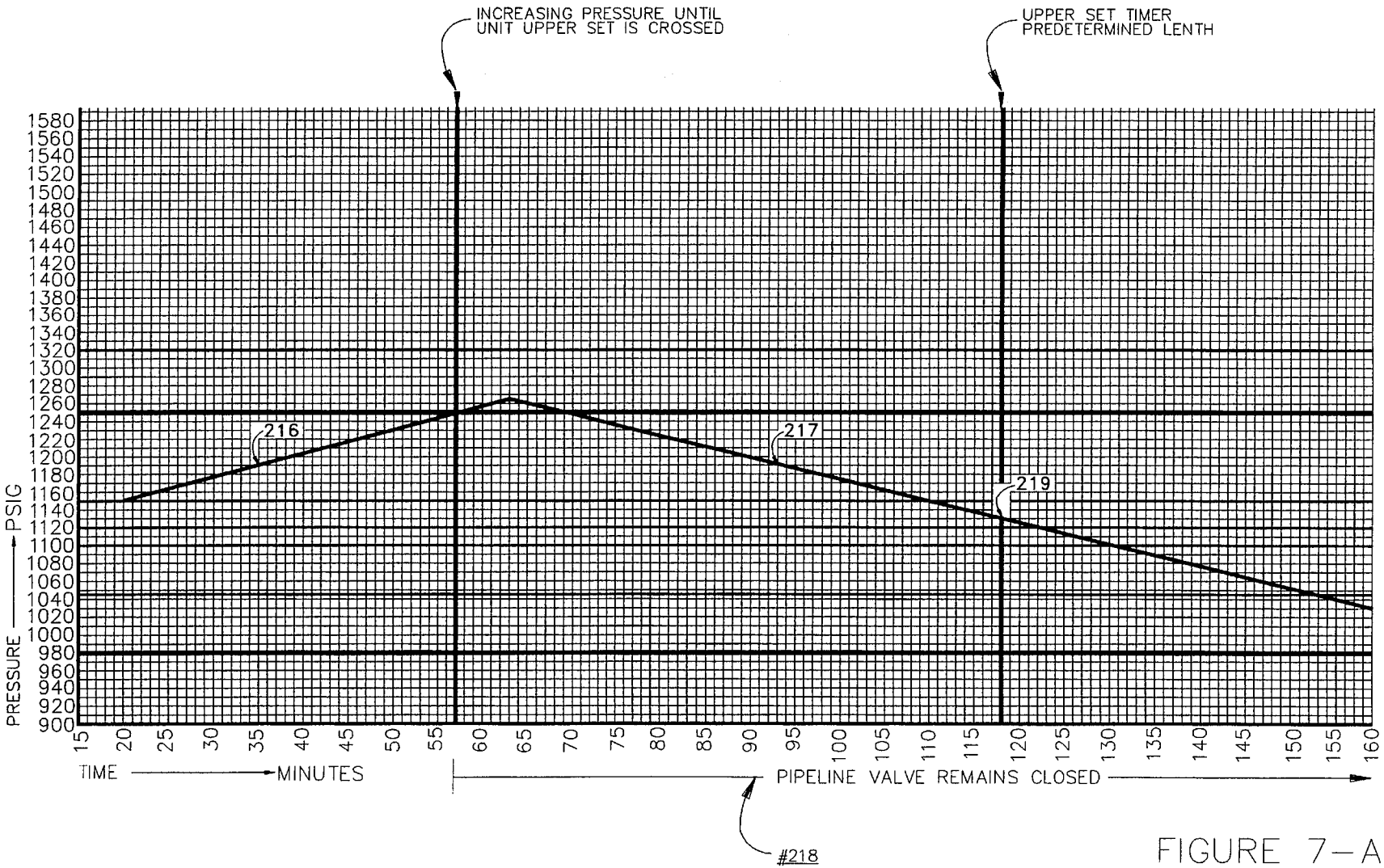
FIGURE 7-A

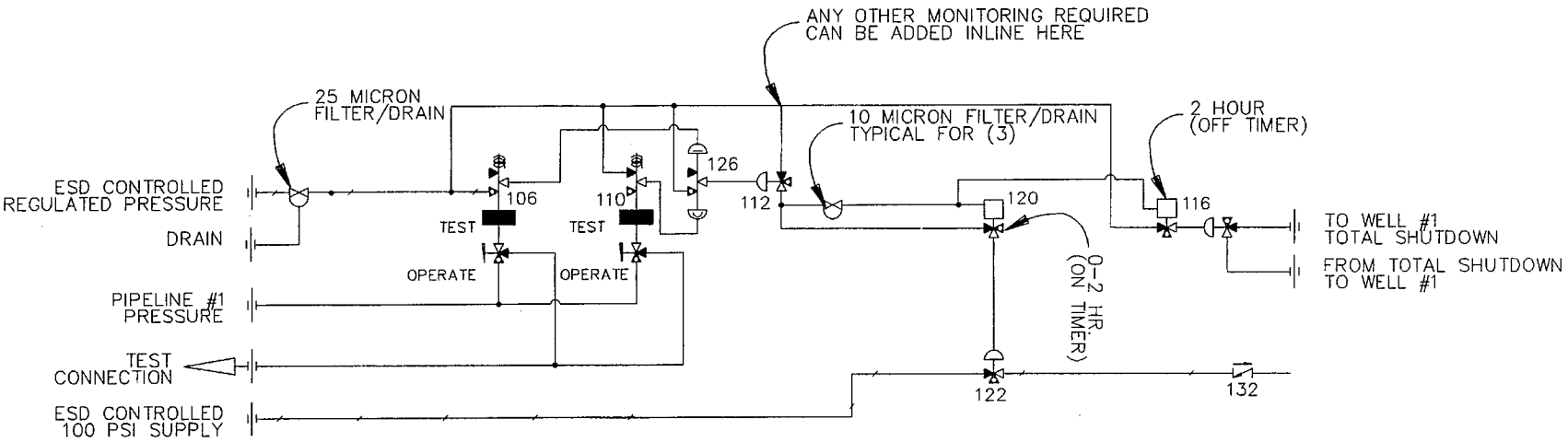
FIGURE 7-B

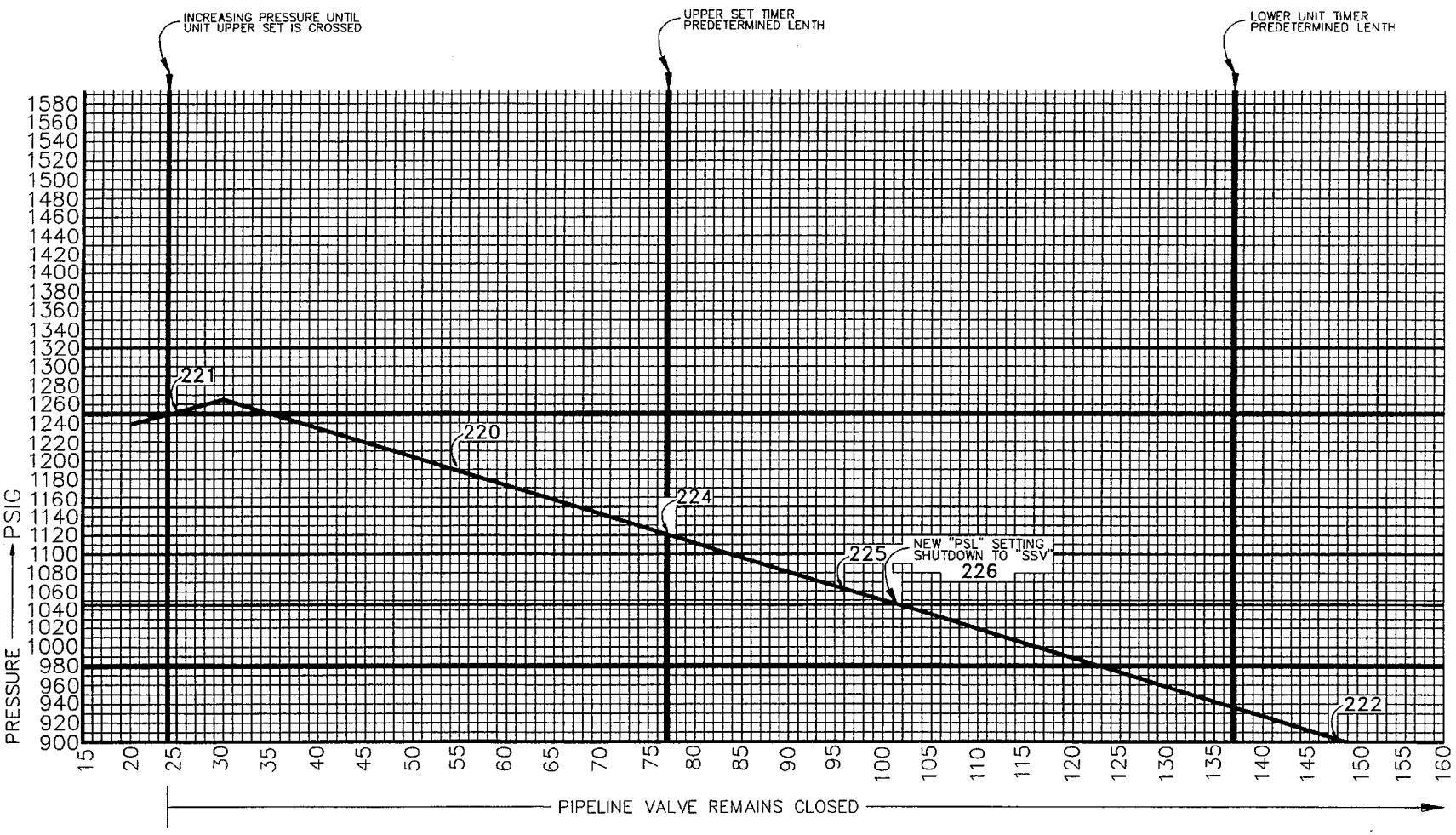
FIGURE 8-A

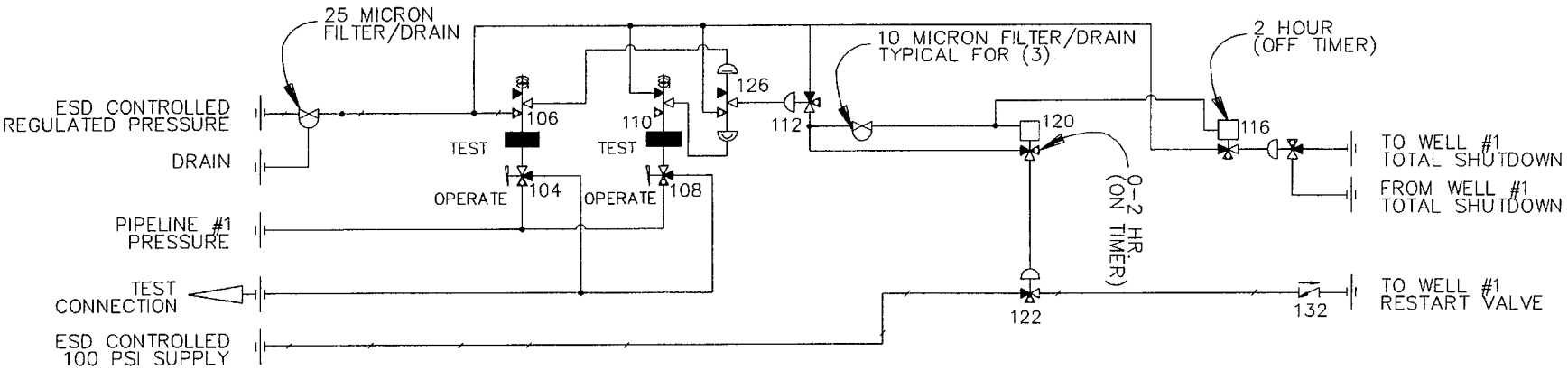
FIGURE 8--B

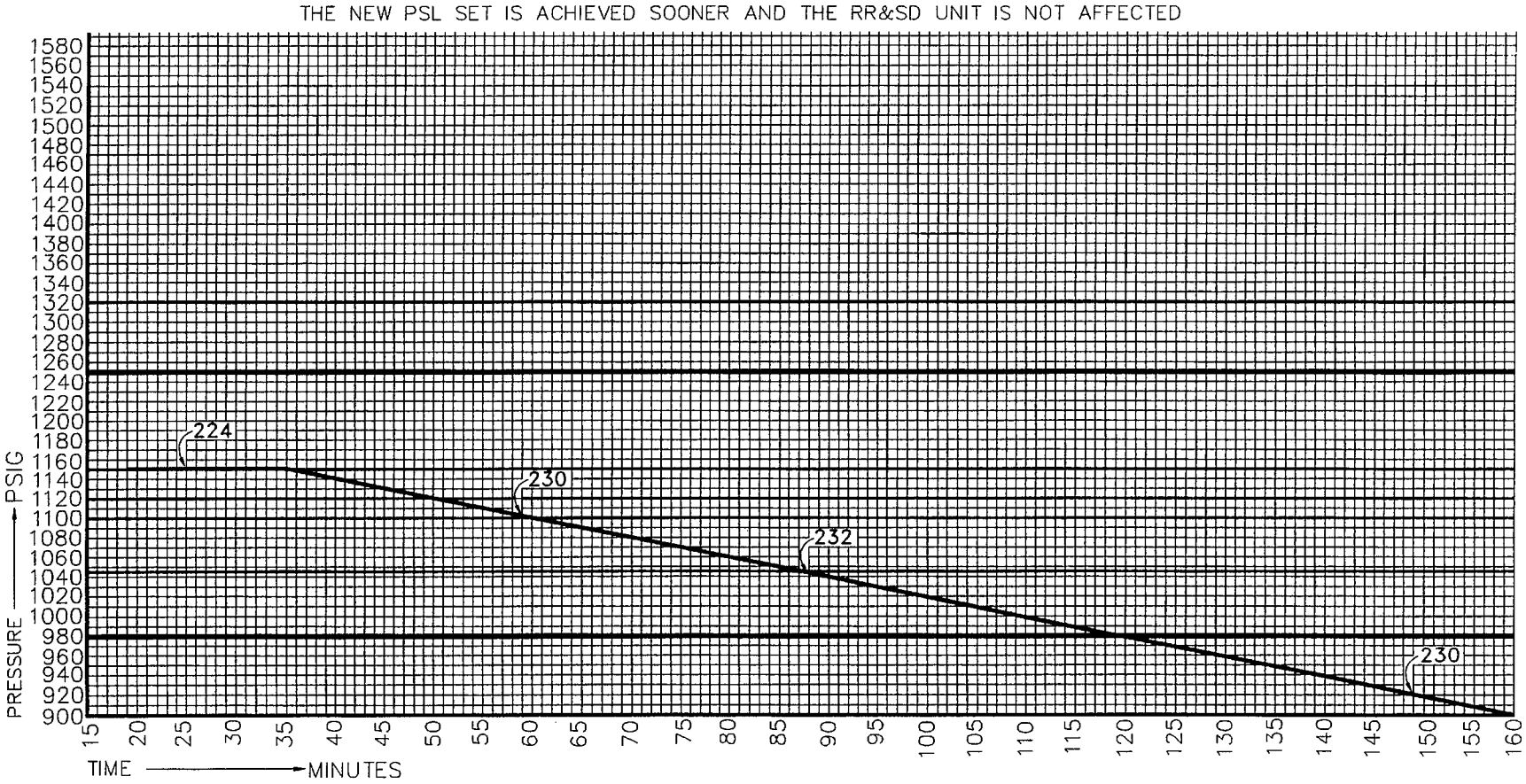
FIGURE 9-A

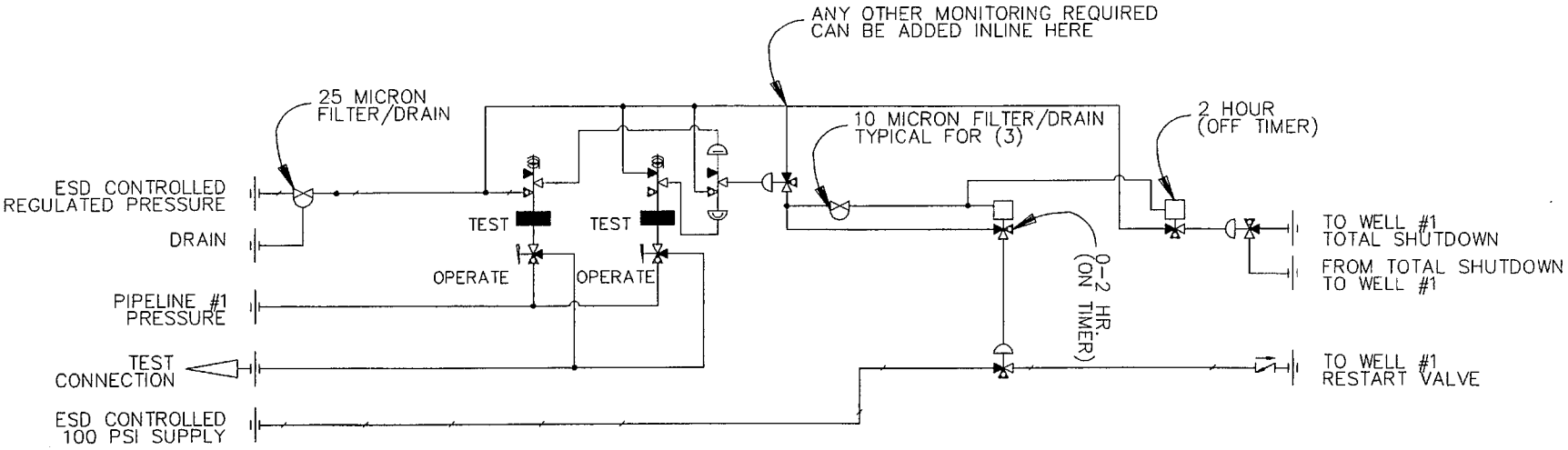
FIGURE 9-B

METHOD AND APPARATUS FOR A SAFETY SYSTEM

BACKGROUND OF THE INVENTION

This invention relates to safety systems. More particularly, but not by way of limitation, the invention relates to safety systems used during the production of oil and gas.

The exploration, development, and production of hydrocarbons involves considerable time, effort and expense. In the earlier days of oil and gas, most wells were completed on land locations. However, as the search continues for significant reservoirs, operators have been increasingly drilling in remote locations, including offshore waters, the arctic, and remote land locations.

The cost involved in the drilling, completion and production of hydrocarbons has always been significant. As the search focus' on these exotic regions, cost have exponentially risen thereby compelling operating companies to search for and produce the reservoirs as economically as possible. The emphasis has been on automation of task as well as minimizing the manpower needed to operate the rigs, platforms and vessels associated with exploration and production.

With reference to the production of the hydrocarbons in offshore waters, operators generally place fixed platforms embedded on the sea floor. The platforms may have production facilities, or alternatively, the platforms may transport the fluids and gas produced to centrally located platforms. Many times the remote platforms are referred to as satellite platforms that produce to a main, receiving platform. Sometimes, in order to economically deplete the reservoirs, the satellite platforms will be unmanned.

Safety to the personnel and environment has always been a major concern of the government regulations that oversee the production of oil & gas in offshore waters. Existing safety systems are numerous, and generally require approval of government regulatory bodies. Certain types of telemetry systems have been devised and are in use. The telemetry systems include SCADA, which is an acronym for Supervisory Control And Data Acquisition.

A problem with the prior art safety systems is that while they effectively shut-in the producing well so that safety is maintained, many times the duration of the shut-in is longer than necessary. Also, another problem with prior art systems is that in order to restart the production, the production personnel are required to physically travel to the remote facility and manually reopen the necessary valves. In particular, once the main platform has been upset, the satellite platform will also shut-in. In order to restart production, a special trip to the remote platform is necessary. In the alternative, some operators use the telemetry systems which obviates the manual restart operation; however, these systems are expensive and rely on operator subjective decisions.

All this is time consuming, expensive, and results in loss production. Therefore, there is a need for a safety system with the appropriate check and balances that will still allow maximum production time.

An advantage of the unit is that it can maximize the amount of production from a remote facility that requires the operator to travel to on a regular basis due to unnecessary shutdown from minor upsets on the receiving platform. Another advantage is that it adds another level of safety to the existing safety system, plus a way to put personnel out of harms way due to high seas, or unsafe flying conditions. Still yet another advantage includes the system of the present invention can be used on offshore satellite platforms, as well as being applicable to remote sites such as snow bound production facilities, or in the alternative, inland marsh locations. Thus, it is to be understood that while production and satellite platform terminology have been used in the description, the invention is certainly applicable to all remote and exotic locations.

SUMMARY OF THE INVENTION

A method of controlling a production platform or remote site is disclosed. The production platform site or remote site contains a well that produces subterranean fluids and gas, and the platform site or production facility is connected to a receiving platform facility by a pipeline and/or flowline. As is understood by those of ordinary skill in the art, the pipeline is under substantial pressure. The production platform site will have a remote control system as disclosed hereafter that has associated with it a control valve. The production platform further contains a standard safety system, as is well known in the industry, containing a surface valve (ssv) and a subsurface valve (scssv).

In one embodiment, the method comprises the steps of setting a pipeline high pressure level (PSH), a pipeline low pressure level (PSL), as is well known in the art. Also, the operator will set a control system upper pressure level determined in accordance with the teachings of the present invention, as well as a lower pressure level. The pipeline pressure will be continuously monitored.

The step of monitoring the pipeline pressure includes detection of a pipeline pressure that surpasses the control system upper pressure level. In this case, the method further comprises the steps of generating a signal in response to the upper pressure level, and activating the control system valve member in order to close the control system valve member. At this point, the well is shut-in at the remote production platform. The control system will then time the length of closure of the control system valve member.

The method may further comprise the steps of observing the pipeline pressure to ensure that pressure is above the upper pressure level, and then in turn, activating an off-timer means for measuring a predetermined amount of time since achieving the upper pressure level. In other words, the off-timer means measures the time the pipeline pressure remains above the upper pressure level. After passage of this predetermined time, the control system will signal the prior art safety system to activate the surface safety valve and the subsurface valve to the closed position effectively shutting-in the production platform.

The method may further comprise the steps of observing a decrease in the pipeline pressure so that the pipeline pressure achieves the control system lower pressure level, and thereafter activating an on-timer means for timing a predetermined time interval; and, generating a signal in response to the expiration of the predetermined time since achieving the control system lower pressure level; and finally, activating the control system valve member in order to open the control system valve member thereby opening the well to production.

The method may further comprise the steps of observing a decrease in the pipeline pressure so that the pipeline pressure achieves the prior art safety system pipeline low pressure level setting, and thereafter allowing the prior art safety system to generate a signal in response to attaining the pipeline low pressure level. Next, the prior art safety control system will activate the surface safety valve so that the surface safety valve is moved to a closed position.

The invention also discloses an apparatus for controlling the production of oil and gas from a satellite platform or remote location to a receiving platform or facility, with the satellite platform and receiving platform being connected by means of a pipeline and/or flowline. The satellite platform will have contained thereon an industry standard safety system. The apparatus comprises a surface valve means, located on the surface of the satellite well and being operably connected to the existing safety system, for regulating the flow of the oil and gas. The apparatus further contains a sub-surface valve means, located beneath the surface of the satellite platform and being operably connected to the safety system, for regulating the flow of the oil and gas; a control system regulating device means, operably associated with a control system valve means, for regulating the flow of oil and gas in response to a sensing means.

The sensing means is located on the satellite platform and is used for sensing the pipeline pressure. The apparatus will also have a signal generating means, operably associated with the sensing means, for generating a signal in response to the sensing means; and, activating means, operably associated with the signal generating means, for activating the regulating device means in response to the sensing means.

In one embodiment, the sensing means contains an upper set pressure means for sensing an upper set pipeline pressure high setting; and the apparatus further contains an off-timer means, operably associated with the sensing means and the surface valve means, for timing the length of time the pipeline pressure is above the upper set pressure means and generating a signal to the signal generating means after the predetermined amount of time so that the sub-surface and surface valve closes thereby shutting-in the well.

The sensing means of the present invention may also contain a lower set pressure means for sensing a lower set pipeline pressure and generating a signal thereto, which will simultaneously turn off the off-timer. The apparatus further contains an on-timer means, operably associated with said sensing means and the off-timer means, for receiving the lower set pressure signal once the pipeline pressure has achieved the lower set pressure, and timing the length of time from the sending of the lower set pressure signal and thereafter allowing the control valve to open.

The sensing means may also contain pressure safety low means for sensing a pressure safety low, and then generating a signal in response thereto so that the surface safety valve closes, thereby effectively shutting-in the platform well.

BRIEF DESCRIPTION OF THE DRAWINGS

FIG. 4A is a graphical illustration of the pressure curves of FIG. 2 plotted with a pressure response curve representing the scenario when the main platform valve is shut-in so that the pipeline pressure is increased.

FIG. 4B is typical flow pattern through the pneumatic flow circuit when the pipeline pressure exceeds the unit upper set.

FIG. 5A is a graphical illustration of the pressure curves of FIG. 2 plotted with a pressure response curve representing the scenario when the main platform valve is reopened so that the pipeline pressure is decreased, the on-timer activated, and the satellite returned to normal flow conditions.

FIG. 5B is a characteristic flow pattern through the pneumatic flow circuit when the pipeline pressure is under normal flowing conditions.

FIG. 6A is a graphical illustration of the pressure curves of FIG. 2 plotted with a pressure response curve representing the scenario when the main platform valve remains closed so that the pipeline pressure stabilizes above the upper set, the off-timer is activated, and the predetermined time is surpassed.

FIG. 6B is a characteristic flow pattern through the pneumatic flow circuit when the pipeline pressure remains above the unit upper set.

FIG. 7A is a graphical illustration of the pressure curves of FIG. 2 plotted with a pressure response curve representing the scenario when the main platform valve remains closed and a minor leak exist.

FIG. 7B is a characteristic flow pattern through the pneumatic flow circuit when the pipeline pressure achieves the unit upper set and thereafter decreases due to a minor leak.

FIG. 8A is a graphical illustration of the pressure curves of FIG. 2 plotted with a pressure response curve representing the scenario when the main platform valve remains closed and a major leak exist but does not thereafter achieve the unit lower set before predetermined time.

FIG. 8B is a characteristic flow pattern through the pneumatic flow circuit when the pipeline pressure achieves the unit upper set and thereafter decreases due to a major leak, then crosses the lower set, and the new PSL set is achieved.

FIG. 9A is a graphical illustration of the pressure curves of FIG. 2 plotted with a pressure response curve representing the scenario when the satellite well is producing and a leak develops at the satellite platform or pipeline.

FIG. 9B is characteristic flow pattern through the pneumatic flow circuit when the satellite well is producing and a leak develops at the satellite platform or pipeline.

DESCRIPTION OF THE PREFERRED EMBODIMENTS

Figure 1:
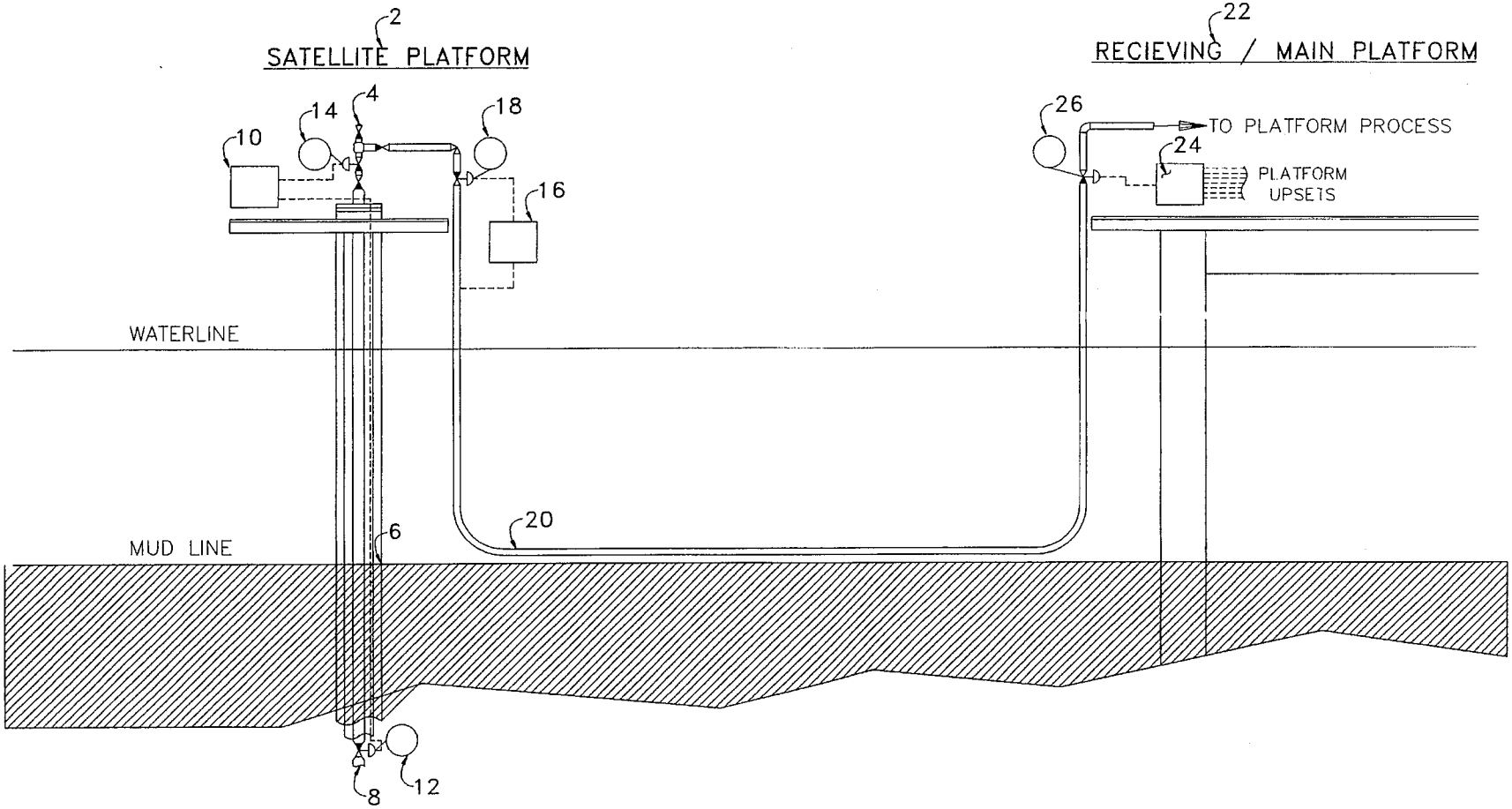
FIG. 1 is a schematic view of a remote platform and main platform being connected by a pipeline.

Referring to FIG. 1, the remote location 2, commonly referred to as satellite platform, will have a well 4 that extends from the satellite platform to the sea floor 6, with the well 4 intersecting a subterranean reservoir 8 that contains hydrocarbons. The well 4 will be completed to the reservoir 8 so that the hydrocarbons from reservoir 8 may be produced to the surface by means of the well 4.

The satellite platform 2 will contain a safety system that may include a pneumatically controlled system, generally depicted at 10. However, the invention herein described is applicable and can be interfaced with other systems including but not limited to electric, acoustic, etc. As part of the safety system 10, a subsurface safety valve 12 will be included in the well, as well as a surface safety valve 14 with both the surface and sub-surface valve being connected to the safety system 10. Such safety systems are well known in the art and may contain many variations of this configuration depending on the ratings and shut-in pressures of the well 4.

The satellite platform 2 will also contain the remote control system 16 of the present invention, that will have remote control valve means 18 for regulating the flow of the fluids and gas of the reservoir 8. Note, that the exact control valve location may vary from location and specific situation.

A pipeline 20 will connect the satellite platform 2 with the receiving platform 22, which is also known as the main platform. The receiving platform 22 may have production separator facilities as well as other producing wells (not shown). The receiving platform will also contain a safety system, depicted at 24, that will have a shut-in valve 26 operably associated therewith.

Figure 2:
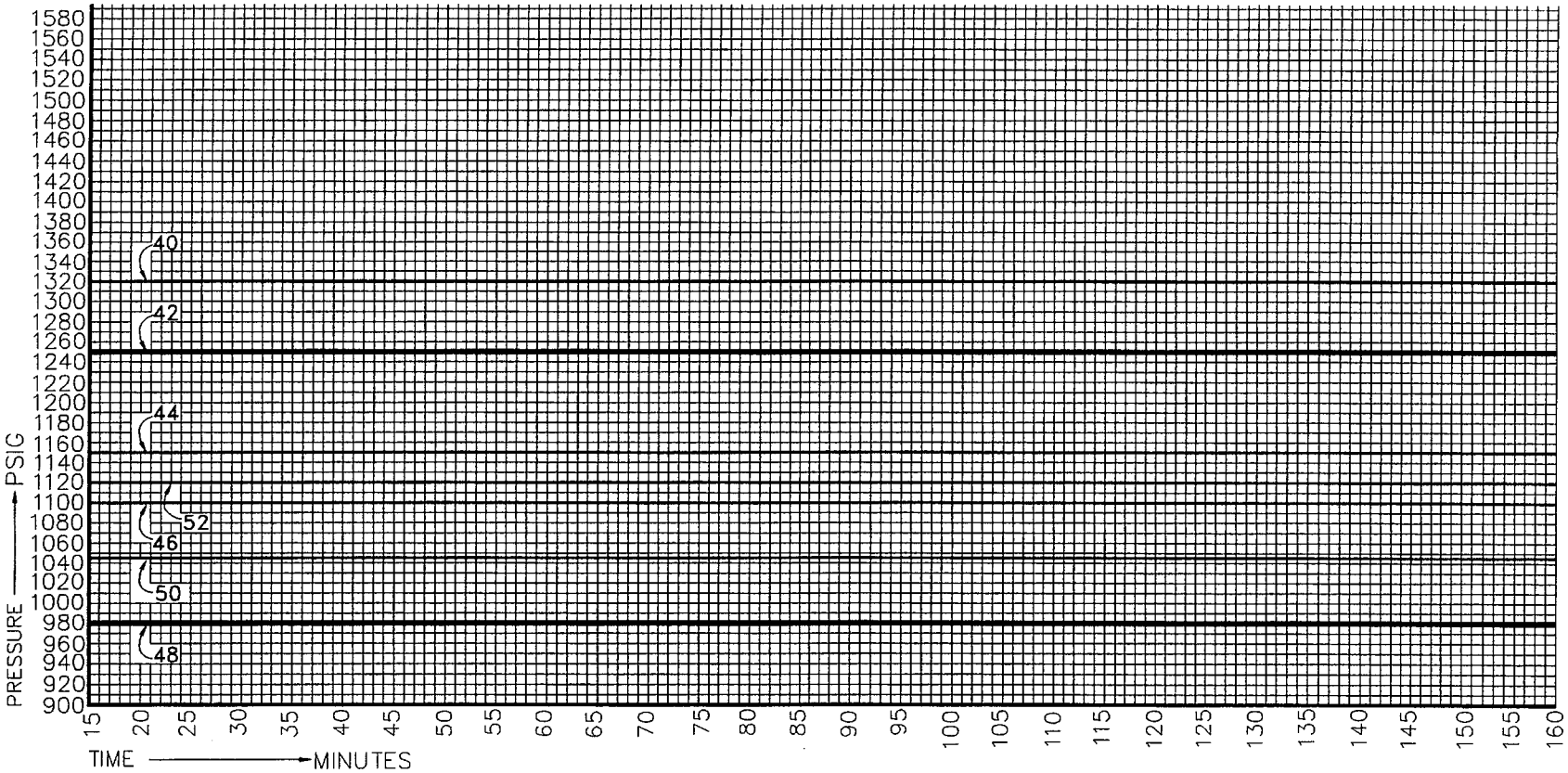
FIG. 2 is a graphical illustration of various pressure curves plotted against time drafted in accordance with the teachings of the invention.

In accordance with the teachings of the present invention, a computation of the various pressure parameters is necessary. Referring to FIG. 2, a graphical representation of various pressure curves is depicted.

The pressure safety high 40 (PSH) shutdown setting is calculated as follows. The PSH is the highest pressure that can be maintained in the pipeline 20 before the surface safety valve 14 shuts-in by means of the safety system 10 on board the satellite platform 2 - - - note: in the embodiment shown, the SCADA system has been replaced. The PSH 40 is computed by sampling the pipeline operating pressure over a period of time about 24 hours and will be accomplished on a range chart. Thereafter, the operator takes the highest reading during that period of time, and then, increasing that pressure by fifteen percent (15%). The method of calculating the PSH is well known in the art.

The remote control system upper set curve 42 can now be computed. The upper set curve 42 is established at approximately five percent (5%) below the PSH 40 shutdown setting. Therefore, if the PSH 40 has been set at 1320 psi, the remote control system upper set curve 42 can be set at approximately 1248 psi. The five percent (5%) is a rule of thumb, however. Other variables include the specific site and how fast events happen. For instance, a short pipeline will have effect/action time responding quickly to a main platform shut in of the pipeline valve 26.

Another important curve to determine is the operating pressure 44, which can be defined as the pressure wherein the pipeline operates under normal flowing conditions. In other words, the operating pressure 44 is the pressure wherein the well 4 is flowing to the receiving platform 22 via the pipeline 20 under normal flowing conditions. The pipeline static pressure 46 is the pressure when the remote platform well is shut-in at the remote site at valve 14, but the incoming pipeline valve 26 on the main structure is open.

As is known by those of ordinary skill in the art, a pressure safety low 48 must be calculated, which will be designated in this application as the "former PSL" shutdown setting. As used by those of ordinary skill in the art, the former PSL 48 is the lowest pressure that can be maintained in the pipeline before the surface safety valve 14 shuts-in by means of the safety system 10. The former PSL 48 is set by observing the pipeline operating pressure 44 during a 24 hour period, and marking the lowest pressure and then taking an eighty-five percent (85%) value of the pipeline pressure 20 at its operating range to come up with the former PSL 48. One range chart is run wherein both the PSH and PSL is computed therefrom.

In accordance with the teaching of the present invention, a new pressure safety low (new PSL) shutdown curve 50 is calculated. The new PSL 50 is the lowest pressure that can be maintained in the pipeline before the surface safety valve 14 shuts-in by means of the safety system 10. The "new PSL 48" setting is approximately 5% above the "old PSL 46". Therefore, if in the prior art, the former PSL was 980 psi, the new PSL setting is approximately 1045 psi.

Next, the remote control system unit lower set curve 52 is determined. This is performed by establishing at approximately 5% above the "new PSL" shutdown set 48. Therefore, if the new PSL has been set at 1045, the remote control system unit lower set curve 52 may be set at approximately 1102 psi. The setting in FIG. 2 is approximately 1120 psi because the actual setting is determined by the pipeline length, size, temperature and operating and static pressures, size, schedule, and pressure. Then, converting into a known volume and calculating a pounds per square inch (psi) per minute at a 20 cubic feet per minute (cfm) leak in order to plot pressure-time chart for correct settings.

Figure 3:
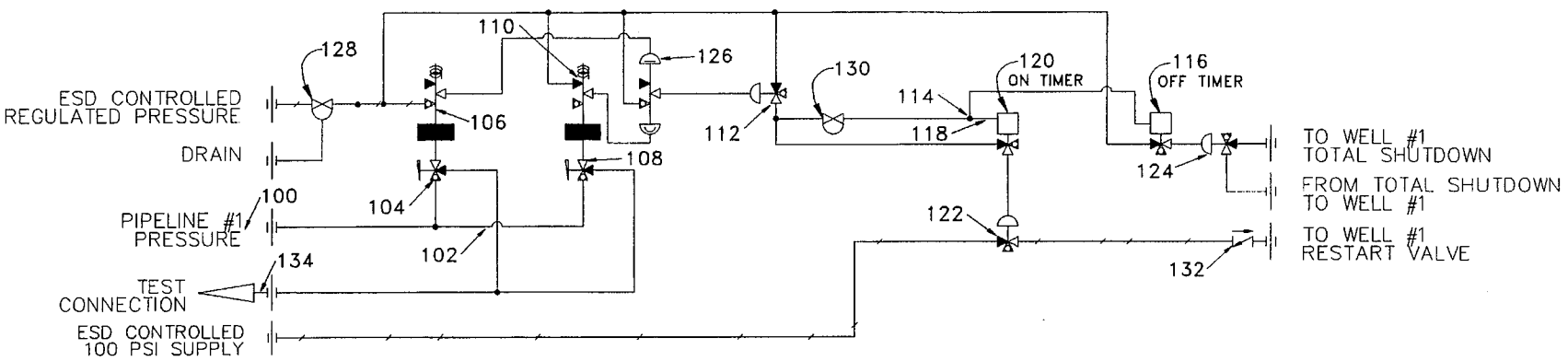
FIG. 3 is a schematic view of the various components of an embodiment of the invention.

Referring to FIG. 3, which is a component diagram of the preferred embodiment of the present invention, the various components of the remote control system unit 16 will now be described. The pipeline pressure 100 is sensed through the conduit 102. A manual 3-way selection valve 104 is positioned such that the pressure is communicated to the start pilot 106. A manual 3-way selection valve 108 is positioned such that the pressure can be communicated to the stop pilot 110.

Both the start pilot 106 and the stop pilot 110 will be connected to the pilot relay 3-way valve 112. From the pilot relay 3-way valve 112, a first segment of conduit 114 will be connected to an off-timer 116., and a second segment of conduit 118 will be connected to an on-timer 120. Both the off-timer 116 and the on-timer 120 will have associated therewith a three-way valve 122, 124 respectfully.

Operably associated with the pilot relay 3-way valve 112 and the start and stop pilot 106, 110 is double pilot 3 way valve 126

Also installed into the conduits will be filters 128 and 130 for filtering out solid particles and condensing fluids in the pneumatic lines. A valve opening control means 132, and a test means 134 is also included. The test means 134 is to set the start pilot 104 and stop pilot 110 to a predetermined pressure set which is described as the upper set and lower set. The valve opening control means 132 is to slowly open the control valve 18 as to not shock the pipeline (open to full flow) in a short period of time.

Referring now to FIG. 4A, a flow chart of the remote control system 16 will now be described. The satellite platform 2 will be in a normal mode of operation 200 i.e. the well 4 is flowing to the receiving platform 22 via the pipeline 20. As will be appreciated by those of ordinary skill in the art, a main platform upset 202 may occur such that the incoming pipeline shut-in valve 26 closes. The closure of valve 26 will in turn cause an increase in the pipeline pressure 203, and the remote control system 16 will sense the increase.

As can be understood with reference to FIG. 2, the pipeline pressure 20 will increase until the upper set curve 42 is reached which will in turn activate the control system 16, and cause the control valve 18 to close at 204. Substantially simultaneously with the closure of valve 18 will be the activation of the timing means 116 which will time the length of duration of the control valve 18 closure. A predetermined length of time has been selected for the timing means 116 which is based on the length and size of the pipeline, as well as the operating and static pressures and temperatures.

As can be seen from FIG. 4B, the flow through the pneumatic circuit with the components of the preferred embodiments as seen in FIG. 3 will be as follows. It should be noted that the portion of the conduit with pressure is shown bolded/highlighted, and the portion with the conduit vented to atmospheric being a normal/non-highlighted line. Thus, once the pressure reaches point 204, the valve 110 will open by shifting which in turn allows the pneumatic line pressure to shift valve 126 and also shifting valve 112 thereby venting to atmosphere the pressure in the conduit 114 and 118. In this position, the off timer 116 will be activated by de-pressuring the conduits 114 and 118 and deactivate on-timer 120 at the same time.

In the event that the main platform 22 is placed back on production, i.e. the shut-in valve is reopened as seen in FIG. 5A at 206, the control system 16 will sense the drop in pipeline pressure 208. Once the pressure falls below the lower setting curve 52, activating the on-timer means 120 for timing the duration the pressure is below the lower setting curve 52. During this time period, the control system is continually checking for leaks because of the continual monitoring of the pipeline pressure 20. At the end of this time interval and if no leak has been detected, a signal will be generated in response thereto, and the control system will be activated in order to open the control system valve 18 returning the well 4 to production with normal flowing pressure 209.

The flow through the pneumatic circuit under this scenario is shown in FIG. 5B. The valve 106 is shifted, or started, because the pipeline pressure has achieved the lower set 52 and is above the static pressure 46 and valve 106 allows, by the before mentioned signal means, the supply pressure to deactivated the off timer 120, and activate the on-timer 120. After the predetermined time, in this position, the valve 122 is positioned such that pressure from the ESD control supply is reaching the control valve 18 and thereby opening the control valve 18 and returning the well to normal flow condition. Note, this is also what the pneumatic circuit looks like during normal operations.

Referring to FIG. 6A, and assuming that the main platform problem is not corrected, and the shut-in valve 26 remains closed, then the off-timer 116 means will expire 212 thereby allowing the remote control system signal means to close the surface safety valve 14 and the subsurface valve 12 and thereafter the pressure remains relatively constant 210 if there are no leaks. Subsequently, the operator of the satellite platform must return to the satellite platform for inspection and manually reset the valves 12 and 14, to the open position.

FIG. 6B shows a characteristic flow pattern through the pneumatic flow circuit when the remote control system valve 18 has shut-in. Since the pipeline pressure is above the unit upper set 42, the valve 110 has shifted thereby causing the valve 126 to shift so that the conduit leading to the off timer 116 is bleed so that off timer 116 is activated. It should be noted that the on timer 120 is deactivated so that valve 122 has vented the supply pressure to valve 132 and the control system valve 18.

In the case where the main platform has an upset such that the shut-in valve 26 is closed, and assuming a leak in the pipeline has occurred, two categories have been addressed: a minor leak (as seen in FIG. 7A) and a major leak (as seen in FIG. 8A).

Referring now to FIG. 7A, in the situation wherein a minor leak occurs (which is less than 20 cubic feet per min.), and the main platform's shut-in valve remains closed 218 because, for instance, the problem is not fixed, the pipeline pressure will increase 216 upon first closure of the shut-in valve 26, and thereafter decrease 217, but at a slow rate thereby allowing the off-timer means to expire 219 and then allowing the control system to signal the close of the surface and subsurface valves 14, 12 respectfully. As can be seen, the lower set 52 was not achieved before the off-timer predetermined time expired.

Referring now to FIG. 7B, which shows a typical flow pattern through the pneumatic flow circuit when the pipeline pressure has exceeded the unit upper set, and therefore, the valve 110 has shifted thereby causing the valve 126 to shift so that the conduit leading to the off timer 116 is bleed so that off timer 116 is activated. It should be noted that the on timer 120 is deactivated so that valve 122 has vented the line pressure to valve 132 and control valve 18. Because of the rate of decline of the pipeline pressure was not fast enough to achieve the unit lower set before the off timer 116 timed out, the off timer 116 shifted thereby signalling a total shutdown effecting closure of the SSV 14 and SCSSV 12.

Referring to FIG. 8A, which is the case where the main platform 22 problem remains uncorrected such that the shut-in valve 26 remains closed, and a major leak is present causing the pressure to decrease rapidly 220 (greater than a 20 cfm leak), then the lower set 58 pressure setting will be reached 224, so that the on-timer means has been activated. Therefore, the on-timer means expires allowing the valve 18 to open after the predetermined time; however, the pressure in the pipeline will continue to fall 225, and because of the leak (in psi per minute rate), and the new PSL pressure setting will be reached at 226 before the control valve 18 is opened due to the timer set being based on the pipeline length, size, temperature, etc. Consequently, the new PSL set will shut down the remote site by closing the surface valve 12. The operator will then have to return to the satellite platform for inspection, and any start-up will have to be manually performed.

As seen in FIG. 8B, the flow through the pneumatic circuit under this scenario is shown. The valve 106 is open, or shifted, because the pipeline pressure is increasing due to closure of shut-in valve 26, increasing pressure achieves 221 the unit upper set 42 signaling the valve 112 to vent the supply pressure to the off timer 116 thereby activating the off timer 116, and the on-timer 118 is deactivated but the off-timer 116 will not shift due to the leak rate will achieve lower set 52 before time expires. With the lower set 52 achieved the off-timer 116 is deactivated when valve 106 is opened or shifted and valve 110 is closed or shifted, activating the on-timer 120 by means of valve 126 and valve 112 allowing supply pressure to the timers 116 and 120. The on-timer 120 starts timing to a predetermined length of time. Once this time elapses, the line pressure is transmitted to valve 122. In this position, the valve 122 is positioned such that pressure from the ESD control supply is reaching the valve 132 and control valve 18 and thereby opening the control valve 18. Note, the control valve has opened; however, the SSV 14 from the prior art safety system and new PSL set 50 has already signaled a shut-in. The platform must be returned to by personnel and manually started-up.

As depicted in FIG. 9A is the scenario wherein the satellite platform 2 is producing 229 to the receiving platform (the receiving platform valve 26 is open); thereafter, a leak develops at the satellite platform 2 or pipeline 20. Note, one of the features of this invention includes that the system is set up to detect pipeline leaks. Thus, the pipeline pressure starts to drop, and assuming a worst case scenario, the leak size starts to increase 230. Once the new PSL 50 setting is achieved 232, the surface safety valve 14 will close pursuant to the safety system 10. Note, that this pressure setting is actually higher than the old PSL 48 thereby allowing shut-in sooner. The operator must then return to the satellite platform 2 for inspection and to reset the safety system 10.

As seen in FIG. 9B, the pneumatic flow circuit will be unchanged in this condition. However, the new psl 50 will be achieved, and therefore, the well is actually shut-in early than the prior art systems. This feature results in less time the leak is producing to the environment.

Changes and modifications in the specifically described embodiments can be carried out without departing from the scope of the invention which is intended to be limited only by the scope of the appended claims.

I claim:

1. A method of controlling a production facility having a satellite platform and a receiving platform, the satellite and receiving platforms being connected by a pipeline, the method comprising the steps of:

flowing the well to the pipeline;

measuring a flowing pipeline pressure at the satellite platform;

calculating an initial pressure safety high shutdown setting;

calculating an upper set pressure shutdown setting for a remote controlled safety system;

comparing said flowing well pressure to said upper set pressure setting; and, activating a first valve means, located on the satellite platform, for regulating the flow of production once the pipeline pressure exceeds the upper set setting.

2. The method of claim 2 further comprising the steps of:

calculating a length of time to set an off-timer means based on pipeline characteristics;

activating the off-timer means for timing the duration of closure of said valve means;

monitoring said pipeline pressure.

3. The method of claim 3 further comprising the steps of:

measuring the amount of time with said off timer means that the pipeline pressure exceeds the upper set setting;

activating a second signal means, located on the satellite platform, for signalling a valve means for regulating the flow of production once the calculated length of preset time has occurred, and wherein said valve means is operably associated with an existing safety control system.

4. The method of claim 3 further comprising the steps of:

calculating a lower set setting for the remote controlled safety system;

measuring the amount of time with said timer means that the pipeline pressure exceeds the upper set;

detecting a decrease in pipeline pressure;

monitoring the decrease in pipeline pressure until the pipeline pressure has achieved the lower set reading.

5. The method of claim 4 further comprising the steps of:

calculating a length of time to set an on-timer means based on pipeline characteristics;

activating an on-timer means for timing the duration of time that the pipeline pressure has remained below the lower set reading;

deactivating the off-timer means;

allowing the well to be placed on production after the length of time for the on-timer has lapsed and no leak has been determined.

6. The method of claim 5 further comprising the steps of:

monitoring the pipeline pressure;

activating the second valve means to the open position so that the satellite well is allowed to flow.

7. The method of claim 5 further comprising the steps of:

calculating a new pressure safety low;

monitoring the pipeline pressure;

detecting a decrease in the pipeline pressure;

comparing the pipeline pressure to the new pressure safety low;

monitoring the decrease in pipeline pressure until the pressure has reached the new pressure safety low setting.

8. The method of claim 7 further comprising the steps of:

activating the surface safety valve means to close so that the satellite well is no longer in production.

9. An apparatus for controlling the production of oil and gas from a satellite platform to a receiving platform, with the satellite platform and receiving platform being connected by a pipeline and with the satellite platform having a safety system, the apparatus comprising:

a surface valve means, located on the surface of the satellite well and being operably connected to the safety system, for regulating the flow of the oil and gas;

a sub-surface valve means, located beneath the surface of the satellite platform and being operably connected to the safety system, for regulating the flow of the oil and gas;

sensing means, located on the satellite, for sensing the pipeline pressure;

a regulating device means, operably associated with said sensing means, for regulating the flow of oil and gas in response to said sensing means;

signal generating means, operably associated with said sensing means, for generating a signal in response to said sensing means;

activating means, operably associated with said signal generating means, for activating said regulating device means in response to said sensing means.

10. The apparatus of claim 9 wherein said sensing means contains:

upper set pressure means for sensing an upper set pipeline pressure high setting; and the apparatus further contains:

an off-timer means, operably associated with said sensing means and said surface and valve means, for timing the length of time the pipeline pressure is above the upper set pressure means and generating a signal to said signal generating means after the predetermined amount of time so that said sub-surface and surface valve closes.

11. The apparatus of claim 10 wherein said sensing means further contains:

lower set pressure means for sensing a lower set pipeline pressure low setting and generating a signal thereto; and the apparatus further contains:

an on-timer means, operably associated with said sensing means and said off-timer means, for receiving said lower set pressure signal once the pipeline pressure has achieved said lower set pressure, and timing the length of time from the sending of said lower set pressure signal.

12. The apparatus of claim 11 wherein said sensing means contains:

pressure safety low means for sensing a pressure safety low, and for generating a signal in response thereto so that said surface valve means shifts to a closed position.

13. A method of controlling a production facility containing a well that produces subterranean fluids and gas, the facility being connected to a receiving facility by a pipeline having a pipeline pressure, the production facility having a control system that has operably associated therewith a controlling valve member, the production facility further containing a safety system containing a surface valve, and a subsurface valve, and the method comprising the steps of:

setting a pipeline high pressure level;

setting a pipeline low pressure level;

setting a control system upper pressure level;

setting a control system lower pressure level;

monitoring the pipeline pressure;

and wherein said step of monitoring the pipeline pressure includes receiving a pipeline pressure that achieves the control system upper pressure level, and the method further comprises the steps of:

generating a signal in response to said upper pressure level;

activating said control system valve member in order to close said control system valve member.

14. The method of claim 13 further comprising:

timing the length of closure of said control system valve member.

15. The method of claim 14 further comprises the steps of:

observing the pipeline pressure to ensure that the pressure is above the upper pressure level;

activating an off-timer means that measures a predetermined amount of time since achieving the upper pressure level;

activating the surface safety valve and the subsurface valve after expiration of the predetermined time period measured by the off-timer.

16. The method of claim 14 further comprising the steps of:

observing a decrease in the pipeline pressure so that the pipeline pressure achieves the control system lower pressure level;

activating an on-timer means for timing a predetermined time interval;

generating a signal in response to the expiration of said predetermined time since achieving the control system lower pressure level;

activating said control system valve member in order to open said control system valve member.

17. The method of claim 16 further comprising the steps of:

observing a decrease in the pipeline pressure so that the pipeline pressure achieves the pipeline low pressure level;

generating a signal in response to the pipeline low pressure level;

activating the surface safety valve to a closed position.

* * * * *